US011107612B2

(12) United States Patent
Matus et al.

(10) Patent No.: US 11,107,612 B2
(45) Date of Patent: Aug. 31, 2021

(54) OVERHEAT PROTECTION DEVICE AND VARISTOR

(71) Applicant: Dongguan Littelfuse Electronics, Co., Ltd, Dongguan (CN)

(72) Inventors: Yuriy B. Matus, Pleasanton, CA (US); Martin G. Pineda, Fremont, CA (US); Dongjian Song, Dongguan (CN)

(73) Assignee: DONGGUAN LITTELFUSE ELECTRONICSCOMPANY LIMITED, Dongguan (CN)

( * ) Notice: Subject to any disclaimer, the term of this patent is extended or adjusted under 35 U.S.C. 154(b) by 0 days.

(21) Appl. No.: 17/015,202

(22) Filed: Sep. 9, 2020

(65) Prior Publication Data

US 2021/0074454 A1 Mar. 11, 2021

(30) Foreign Application Priority Data

Sep. 9, 2019 (CN) ..... 201910850036.1
Sep. 9, 2019 (CN) ..... 201921493615.7

(51) Int. Cl.
*H01C 7/12* (2006.01)
*H01C 1/14* (2006.01)

(52) U.S. Cl.
CPC ..... *H01C 7/12* (2013.01); *H01C 1/14* (2013.01)

(58) Field of Classification Search
CPC ..... H01C 7/12; H01C 1/14
See application file for complete search history.

(56) References Cited

U.S. PATENT DOCUMENTS 5,781,394 A * 7/1998 Lorenz ..... H01C 7/10 337/142
2005/0140491 A1 6/2005 Uehara et al.
2007/0200657 A1* 8/2007 Tsai ..... H01C 7/126 338/21
2008/0129440 A1* 6/2008 Ho ..... H01C 1/08 337/5
2011/0057761 A1 3/2011 Wang et al.
2012/0001720 A1 1/2012 Kimura et al.
(Continued)

FOREIGN PATENT DOCUMENTS

CN 207529743 U 6/2018

OTHER PUBLICATIONS

CN 207529743; machine translation. (Year: 2017).*
International Search Report and Written Opinion dated Nov. 30, 2020 for PCT/US20/49811.

*Primary Examiner* — Kyung S Lee
(74) *Attorney, Agent, or Firm* — Kacvinsky Daisak Bluni PLLC

(57) ABSTRACT

An overheat protection device and a varistor are provided. The overheat protection device comprises: a first electrode and a second electrode disposed to be spaced apart; a hot-melt wire located between the first electrode and the second electrode, the hot-melt wire being in electrical contact with the first electrode and the second electrode; and an insulator supporting the first electrode and the second electrode, wherein the hot-melt wire is melted into a liquid hot-melt material when the ambient temperature reaches a predetermined temperature, the liquid hot-melt material wets the first electrode and the second electrode, and the liquid hot-melt material does not wet the insulator at least at a portion located between the first electrode and the second electrode.

10 Claims, 4 Drawing Sheets

(56) References Cited

U.S. PATENT DOCUMENTS

| | | | | |
|---|---|---|---|---|
| 2012/0068806 | A1* | 3/2012 | Guarniere | H01C 7/10 337/1 |
| 2016/0125983 | A1* | 5/2016 | Hsu | H01C 1/144 338/21 |
| 2018/0102640 | A1 | 4/2018 | Crevenat | |
| 2018/0315576 | A1* | 11/2018 | Tsang | H01C 17/06586 |

* cited by examiner

OVERHEAT PROTECTION DEVICE AND VARISTOR

CROSS REFERENCE TO RELATED APPLICATION

This application claims the benefit of priority to, Chinese Patent Application No. 201910850036.1, filed Sep. 9, 2019, entitled "Overheat Protection Device and Varistor," and Chinese Utility Model Application No. 201921493615.7 filed Sep. 9, 2019, entitled "Overheat Protection Device and Varistor," which applications are incorporated herein by reference in its entirety.

TECHNICAL FIELD

The present invention relates to the field of circuit protection, and in particular, to an overheat protection device and a varistor.

BACKGROUND

A varistor is a resistor device provided with nonlinear volt-ampere characteristics, and is mainly used for performing voltage clamping when a circuit is subjected to overvoltage and absorbing redundant current so as to protect a sensitive device. A varistor is equivalent to a variable resistor connected in parallel in the circuit. When the circuit is in normal use, the varistor has a high impedance and small leakage current, and can be regarded as an open circuit having little effect on the circuit. However, when very high surge voltage occurs, the resistance of the varistor drops instantaneously (the resistance may change from the megaohm level to the milliohm level), causing it to allow a large current to flow through while clamping the overvoltage at a certain value.

A thermally protected varistor is a product capable of providing instant heat removal. This property is achieved by an alloy type thermal fuse and a varistor through an internal effective thermocouple and the structure thereof. A thermally protected varistor has multiple protective functions for overvoltage, overcurrent, and overtemperature. The varistor is promptly removed from the circuit by fusing the alloy in an overvoltage, overcurrent, or overtemperature, thus preventing fires caused by the varistor being continuously overheated.

However, in the above structure, when the alloy of the fuse is fused, no effective physical isolation structure between the fused alloy material and electrodes of the varistor exists. The varistor may still be connected to the circuit, and the varistor may catch on fire from being overheated continuously, thus posing a certain potential for safety hazards.

SUMMARY

In order to solve at least one aspect of the above problems, an overheat protection device and a varistor are provided in embodiments of the present disclosure.

An overheat protection device is provided in an embodiment of the present disclosure, including: a first electrode and a second electrode disposed to be spaced apart; a hot-melt wire located between the first electrode and the second electrode, the hot-melt wire being in electrical contact with the first electrode and the second electrode; and an insulator supporting the first electrode and the second electrode, wherein the hot-melt wire is melted into a liquid hot-melt material when the ambient temperature reaches a predetermined temperature, the liquid hot-melt material wets the first electrode and the second electrode, and the liquid hot-melt material does not wet the insulator at least at a portion located between the first electrode and the second electrode.

In some embodiments, the insulator comprises a plate-shaped or corrugated structure, and the first electrode, the second electrode, and the hot-melt wire are disposed on one side of the plate-shaped or corrugated structure.

In some embodiments, the overheat protection device further comprises: a protective layer, wherein the protective layer and the plate-shaped or corrugated structure enclose a cavity; at least a portion of the first electrode, at least a portion of the second electrode, and the hot-melt wire are accommodated in the cavity.

In some embodiments, the liquid hot-melt material does not wet the protective layer.

In some embodiments, the overheat protection device further comprises at least one wetting component, the one wetting component is disposed between the first electrode and the second electrode, the first electrode, the at least one wetting component, and the second electrode are successively and sequentially arranged to be spaced apart in an extension direction of the hot-melt wire, and the liquid hot-melt material wets the wetting component.

In some embodiments, the insulator comprises a cylindrical structure, and the first electrode, the second electrode, and the hot-melt wire are disposed in the cylindrical structure.

In some embodiments, at least one of the first electrode and the second electrode is a layered electrode, a columnar electrode, or a sponge electrode.

A varistor is provided in an embodiment of the present disclosure, the varistor comprising: a varistor body; and the overheat protection device disposed on the pressure-sensitive electronic body as described according to the above embodiments, wherein compared with the first electrode and the second electrode, the insulator is closer to the varistor body.

In some embodiments, the varistor body comprises a first electrode layer, a varistor chip, and a second electrode layer disposed sequentially to be stacked, and the second electrode layer and the insulator are disposed to face each other.

In some embodiments, the varistor comprises a heat conductive layer, and the heat conductive layer is disposed between the insulator and the second electrode layer.

In some embodiments, the second electrode layer is electrically connected to one of the first electrode and the second electrode, and the varistor further comprises: a first pin, the first pin being electrically connected to the first electrode layer; and a second pin, the second pin being electrically connected to the other one of the first electrode and the second electrode.

In some embodiments, the varistor further comprises an encapsulation layer, the encapsulation layer cladding the varistor body and the overheat protection device.

BRIEF DESCRIPTION OF THE DRAWINGS

From the description of the present invention in the following and with reference to accompanying drawings, other objectives and advantages of the present invention will become apparent and can help one understand the present invention thoroughly.

DETAILED DESCRIPTION

Figure 1:
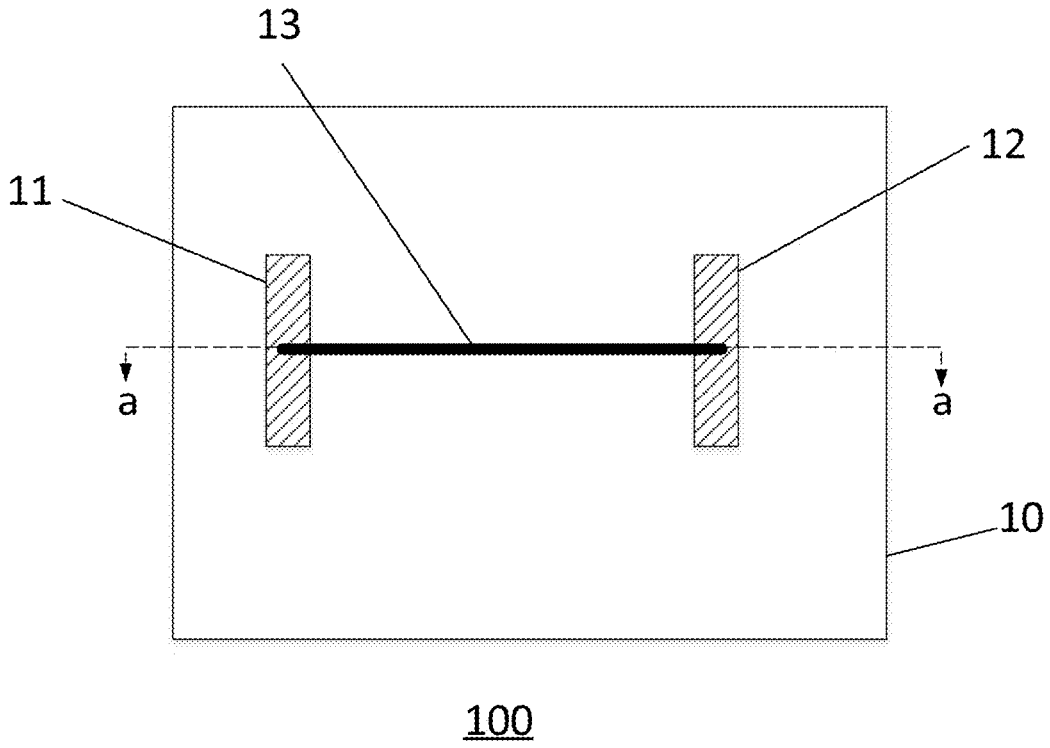
FIG. 1 is a schematic structural plan view of an overheat protection device according to an embodiment of the present disclosure.

The technical solutions of the present invention will be further described specifically below through embodiments with reference to the accompanying drawings. In the description, the same or similar reference numerals indicate the same or similar members. The description of implementation manners of the present invention below with reference to the accompanying drawings is intended to explain the general inventive concept of the present invention, and should not be construed as limitations to the present invention.

In addition, in order to provide a clear explanation and a thorough understanding of the embodiments of the present disclosure, numerous specific details are set forth in the following detailed description. However, it is obvious that one or a plurality of embodiments can still be implemented without these specific details.

It should be noted that "on," "formed on," and "disposed on" as described herein may indicate that one layer is formed or disposed on another layer directly, and may also indicate that one layer is formed or disposed on another layer indirectly, i.e., another layer exists between the two layers.

It should be noted that terms such as "first" and "second" may be used herein for describing various members, components, elements, regions, layers, and/or portions; however, these members, components, elements, regions, layers and/or portions should not be limited by these terms. Instead, these terms are used for distinguishing one member, component, element, region, layer and/or portion from another. Therefore, for example, a first member, a first component, a first element, a first region, a first layer, and/or a first portion discussed below may be referred to as a second member, a second component, a second element, a second region, a second layer and/or a second portion without departing from the teaching of the present disclosure.

An overheat protection device is provided in the present disclosure. The overheat protection device includes a first electrode and a second electrode disposed to be spaced apart; a hot-melt wire located between the first electrode and the second electrode; a first end of the hot-melt wire being in electrical contact with the first electrode; and a second end of the hot-melt wire being in electrical contact with the second electrode; and an insulator supporting the first electrode and the second electrode. The hot-melt wire is melted into a liquid hot-melt material when the ambient temperature reaches a predetermined temperature; the liquid hot-melt material wets the first electrode and the second electrode, and the liquid hot-melt material does not wet the insulator at least at a portion located between the first electrode and the second electrode.

Regarding the overheat protection device provided by the present disclosure, the materials of the first electrode, the second electrode, and the insulator are selected such that the liquid hot-melt material wets the first electrode and the second electrode and does not wet at least a portion of the insulator. As a result, when the hot-melt wire is melted when the ambient temperature reaches the predetermined temperature, the liquid hot-melt material is collected at the first electrode and the second electrode that are spaced apart from each other, so that the first electrode and the second electrode are completely insulated, thereby ensuring that the thermal protection device is in a complete open-circuit state.

Figure 2:
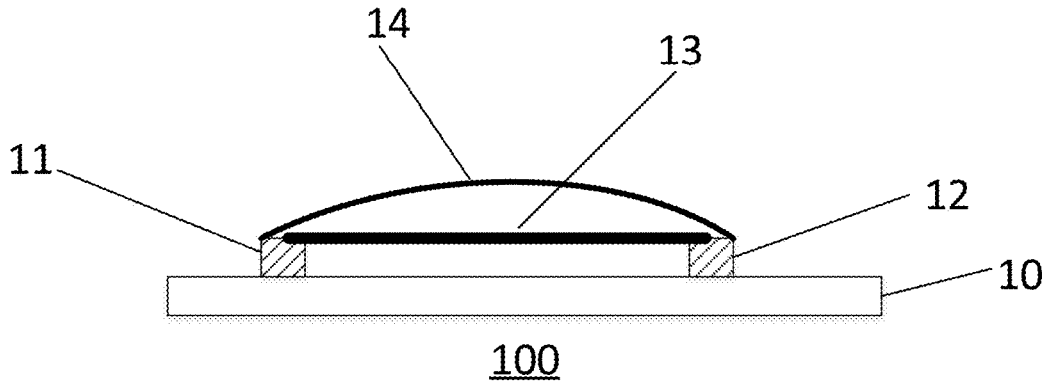
FIG. 2 is a schematic cross-sectional structural view of FIG. 1 taken along a line aa.

Specifically, an overheat protection device 100 is provided in an embodiment of the present disclosure. FIG. 1 is a schematic structural plan view according to the overheat protection device 100. FIG. 2 is a schematic cross-sectional structural view of FIG. 1 taken along the line aa. As shown in FIG. 1 and FIG. 2, the overheat protection device 100 includes an insulator 10, a first electrode 11 and a second electrode 12 located on the insulator 10, and a hot-melt wire 13 electrically connecting the first electrode 11 and the second electrode 12. In this embodiment, the insulator is of a plate-shaped or corrugated structure (an example of a plate-shaped structure is shown in FIG. 1). The first electrode 11 and the second electrode 12 are located on one side of the insulator 10 and are disposed to be spaced apart from each other. Two ends of the hot-melt wire 13 are in electrical contact with the first electrode 11 and the second electrode 12, respectively. For example, the two ends of the hot-melt wire 13 are soldered to the first electrode 11 and the second electrode 12, respectively.

The hot-melt wire 13 can be made of a conductive material having a lower melting point, such as tin, aluminum-antimony alloy, tin-bismuth alloy, tin-copper alloy, and tin-silver-copper alloy. Thus, when the ambient temperature reaches the predetermined temperature, the hot-melt wire 13 is melted and broken, so that the electrical connection between the first electrode 11 and the second electrode 12 of the overheat protection device 100 is broken, and the overheat protection device 100 is in an open-circuit state.

Figure 3:
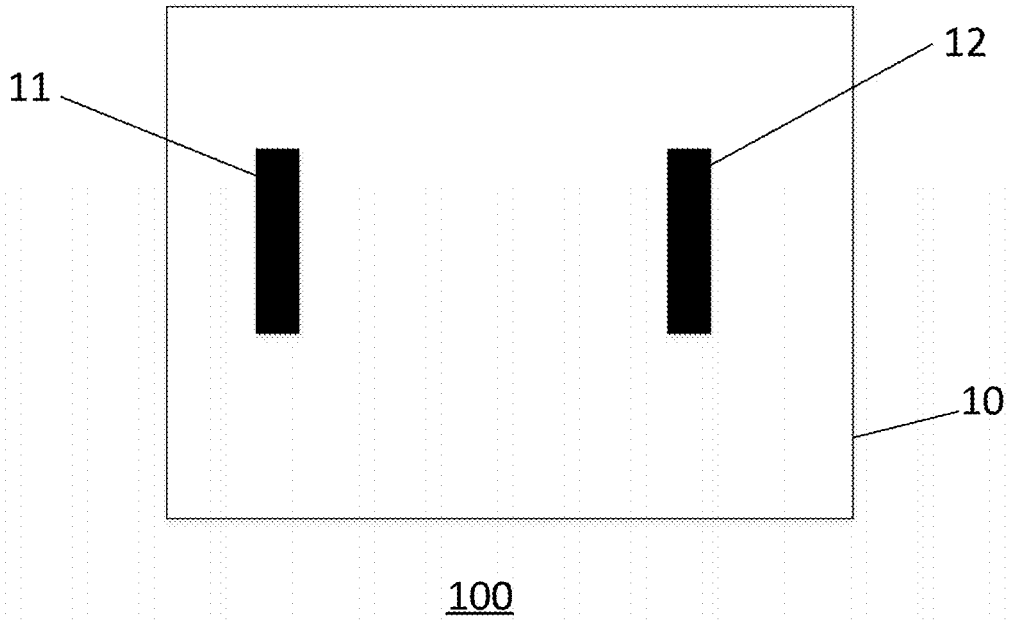
FIG. 3 is a schematic structural plan view of the overheat protection device in FIG. 1 when a hot-melt wire is melted.

The insulator 10 of the plate-shaped or corrugated structure can be made of a material such as ceramic, glass, alumina, SiN, and polyimide (PI) to ensure that the liquid hot-melt material does not wet the insulator 10. The first electrode 11 and the second electrode 12 have melting points higher than the melting point of the hot-melt wire 13, and can be made of a material such as Cu, Ag, Au, Ni, and Pd, to ensure that the liquid hot-melt material wets the first electrode 11 and the second electrode 12 of the insulator. Therefore, when the hot-melt wire 13 is melted when the ambient temperature reaches the predetermined temperature, the liquid hot-melt material flows under the action of surface tension of the liquid hot-melt material, and is collected at the first electrode 11 and the second electrode 12 that are spaced apart from each other. Substantially no liquid hot-melt material is present on the surface of the insulator 10 between the first electrode 11 and the second electrode 12. As shown in FIG. 3, the liquid hot-melt material flows to and is collected at the first electrode 11 and the second electrode 12, and covers the first electrode 11 and the second electrode 12. As a result, the first electrode 11 and the second electrode 12 are completely insulated, thereby ensuring that the thermal protection device 100 is in a complete open-circuit state.

In this embodiment, the first electrode 11 and the second electrode 12 each have a layered structure. For example, the first electrode 11 and the second electrode 12 may be copper pads disposed on one side of the insulator 10 and spaced apart from each other.

In some embodiments, it is also possible to provide an arrangement in which only a portion of the insulator 10 located between the first electrode 11 and the second electrode 12 is not wet by the liquid hot-melt material.

In some embodiments, the overheat protection device 10 may further include a protective layer 14 to avoid external interference with the fluidity of the liquid hot-melt material and to ensure the flow of the liquid hot-melt material under surface tension, as shown in FIG. 2 (the protective layer is not shown in FIG. 1). The protective layer 14 and the insulator 10 having a plate-shaped or corrugated structure enclose a cavity, and at least a portion of the first electrode 11, at least a portion of the second electrode 12, and the hot-melt wire 13 are accommodated in the cavity. The protective layer 14 can be made of a material such as SiN and polyimide (PI), and the liquid hot-melt material does not wet the protective layer 14. Therefore, the liquid hot-melt material formed by melting the hot-melt wire 13 can be collected at the first electrode 11 and the second electrode 12 in the cavity under the action of surface tension. The protective layer 14 thus ensures that the fluidity of the liquid hot-melt material is not interfered by external factors.

In some embodiments, the distance between the first electrode and the second electrode 12 is, for example, greater than or equal to 9 mm, ensuring that the liquid hot-melt materials respectively collected at the first electrode 11 and the second electrode 12 are sufficiently separated.

Figure 4:
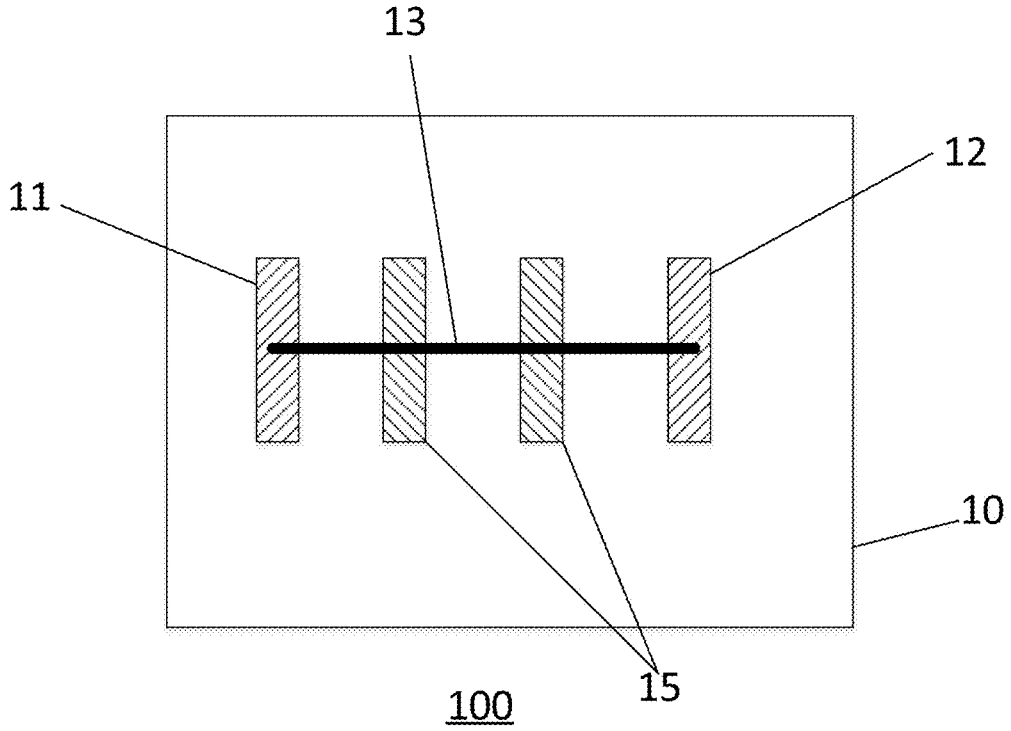
FIG. 4 is a schematic structural plan view of an overheat protection device according to another embodiment of the present disclosure.

FIG. 4 is a schematic structural plan view of an overheat protection device according to another embodiment of the present disclosure, which differs from the overheat protection device shown in FIG. 1 in that the overheat protection device 10 further includes at least one wetting component 15, for example, two wetting components. The wetting component 15 is also disposed on the insulator 10 and located between the first electrode 11 and the second electrode 12. The first electrode 11, the second electrode 12, and the wetting component 15 are disposed to be spaced apart from each other. For example, as shown in FIG. 4, the first electrode 11, the second electrode 12, and the wetting component 15 each have an elongated shape and collectively form a zebra crossing shape. The wetting component 15 can be made of a material such as Cu, Ag, Au, Ni, and Pd, such that the liquid hot-melt material wets the wetting component 15. When the hot-melt wire 13 is melted into the liquid hot-melt material when the ambient temperature reaches the predetermined temperature, the liquid hot-melt material is collected at the first electrode 11, the second electrode 12, and the wetting component 15 that are spaced apart from each other, and the liquid hot-melt material is divided into a plurality of portions disconnected to each other, so that the first electrode 11 and the second electrode 12 are completely insulated, thereby ensuring that the thermal protection device 100 is in a complete open-circuit state. The overheat protection device in this embodiment can be used in a case where the amount of the liquid hot-melt material melted from the hot-melt wire 13 is comparatively large.

In some embodiments, the wetting component 15 can be made of the same material as the first electrode 11 and the second electrode 12. In this case, the wetting component 15 can be formed on the insulator 10 simultaneously with the first electrode 11 and the second electrode 12, thus simplifying the preparation process.

In the above embodiment, the first electrode 11 and the second electrode 12 each have a layered structure. In other embodiments, the first electrode 11 and the second electrode 12 may also adopt a columnar structure or a sponge structure.

It can be understood by those skilled in the art that although the overheat protection device 100 shown in FIG. 1 and FIG. 4 has a rectangular shape as a whole, this feature does not serve as a limitation of the present disclosure; the overheat protection device 100 may have another shape, such as a circular shape and a diamond shape.

Figure 5:
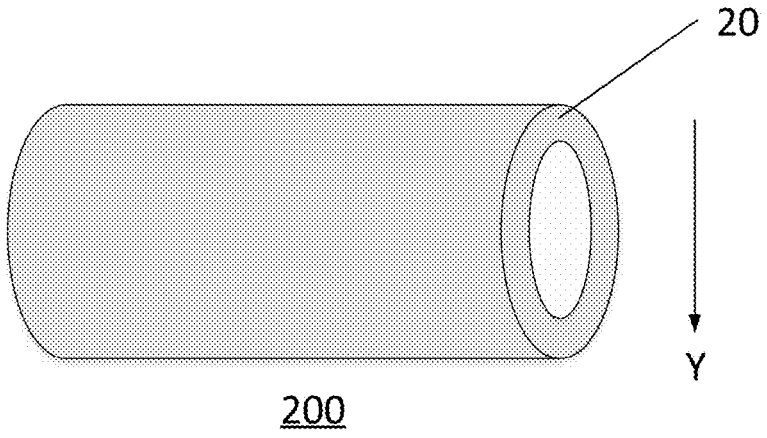
FIG. 5 is a schematic structural view of an overheat protection device according to another embodiment of the present disclosure.
Figure 6:
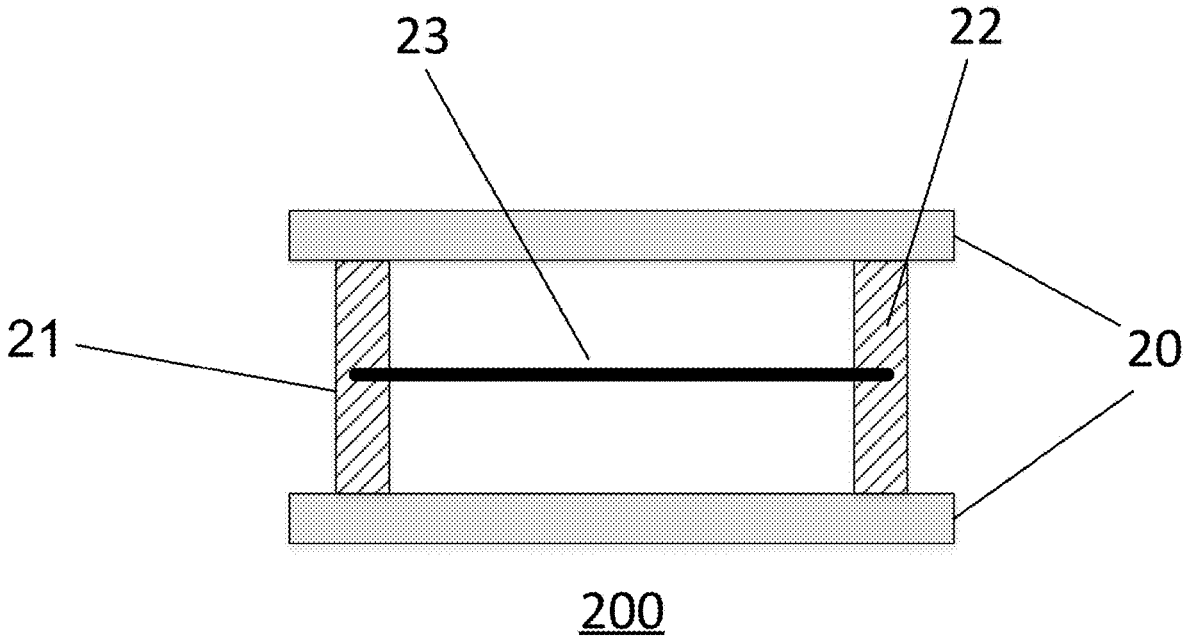
FIG. 6 is a cross-sectional view of FIG. 5 taken along a plane parallel to a Y direction and including an axis of a cylinder.

An overheat protection device is provided in another embodiment of the present disclosure. FIG. 5 is a schematic structural view of an overheat protection device according to the embodiment, and FIG. 6 is a cross-sectional diagram of FIG. 5 taken along a plane parallel to a Y direction and including an axis of a cylinder. In this embodiment, as shown in FIG. 5 and FIG. 6, an overheat protection device 200 includes an insulator 20. Different from the above implementation, the insulator 20 in this embodiment is a hollow tube, and the hollow tube may be of a hollow cylindrical structure, a hollow square column structure, or the like, which is not limited herein. This embodiment is illustrated by taking the hollow cylindrical structure shown in FIG. 5 as an example.

The overheat protection device 200 further includes a first electrode 21, a second electrode 22, and a hot-melt wire 23 that are accommodated in the hollow tube. As shown in FIG. 5, the first electrode 21 and the second electrode 22 are respectively disposed in the hollow tube near two ends. The first electrode 21 and the second electrode 22 are spaced apart by a predetermined distance that is, for example, equal to or greater than 9 mm. Two ends of the hot-melt wire 23 are in electrical contact with the first electrode 21 and the second electrode 22, respectively. For example, the two ends of the hot-melt wire 23 are soldered to the first electrode 21 and the second electrode 22, respectively.

The hot-melt wire 23 can be made of a conductive material having a lower melting point, such as tin, aluminum-antimony alloy, tin-bismuth alloy, tin-copper alloy, and tin-silver-copper alloy. As a result, when the ambient temperature reaches a predetermined temperature, the hot-melt wire 23 is melted and broken, so that the electrical connection between the first electrode 21 and the second electrode 22 of the overheat protection device 200 is broken, and the overheat protection device 200 is in an open-circuit state.

The insulator 20 of the hollow tubular structure can be made of a material such as ceramic, glass, SiN, and polyimide (PI), so as to ensure that the liquid hot-melt material does not wet the insulator 20. The first electrode 21 and the second electrode 22 have melting points higher than the melting point of the hot-melt wire 23, and can be made of a material such as Cu, Ag, Au, Ni, and Pd, so as to ensure that the liquid hot-melt material wets the first electrode 21 and the second electrode 22 of the insulator. As a result, when the hot-melt wire 23 is melted when the ambient temperature reaches the predetermined temperature, the liquid hot-melt material flows under the action of surface tension of the liquid hot-melt material, and is collected at the first electrode 21 and the second electrode 22 that are spaced apart from each other. Substantially, no liquid hot-melt material is present on the inner surface of the insulator 20 between the first electrode 21 and the second electrode 22. The first electrode 21 and the second electrode 22 are completely insulated, thereby ensuring that the thermal protection device 200 is in a complete open-circuit state.

In this embodiment, the first electrode 21 and the second electrode 22 may each be a plate-shaped structure, and they enclose a closed space together with the hollow tubular insulator 20.

In some embodiments, the first electrode 21 and the second electrode 22 may be a sponge electrode which is an electrode block having a porous structure such that the liquid hot-melt material is more easily adsorbed onto the first electrode 21 and the second electrode 22. It is thus ensured that the first electrode 21 and the second electrode 22 are completely insulated and that the thermal protection device 200 is in a complete open-circuit state.

Figure 7:
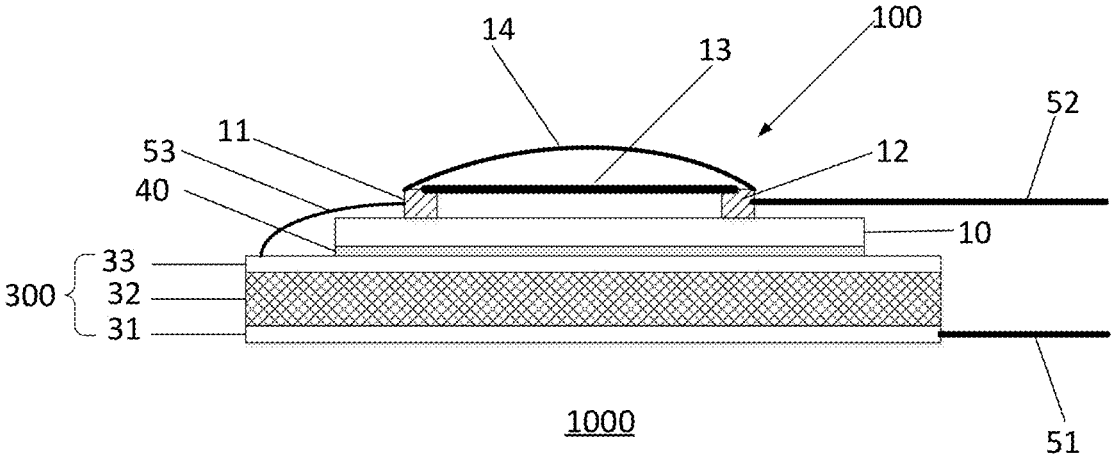
FIG. 7 is a schematic cross-sectional structural view of a varistor according to an embodiment of the present disclosure.

A varistor is provided in an embodiment of the present disclosure. The varistor may be an overheat protection varistor, and FIG. 7 shows a schematic cross-sectional structural view of this type of varistor. As shown in FIG. 7, a varistor 1000 includes a varistor body 300 and an overheat protection device disposed on the pressure-sensitive electronic body 300. Various overheat protection devices in the foregoing embodiments may be adopted as the overheat protection device. Here, illustration is made only by taking the overheat protection device 100 shown in FIG. 1 and FIG. 2 as examples.

As shown in FIG. 7, the varistor body 300 includes a first electrode layer 31, a varistor chip 32, and a second electrode layer 33 disposed sequentially to be stacked. The varistor chip 32 may be a metal oxide varistor chip such as a zinc oxide varistor chip. The varistor chip may have various shapes such as a circular shape and a square shape, which is not particularly limited herein. The first electrode layer 31 and the second electrode layer 33 are respectively disposed on two sides of the varistor chip 32. The first electrode layer 31 and the second electrode layer 33 can each be made of a metal material, for example, a metal material such as Cu, Ag, and Al, or an alloy thereof. The first electrode layer 31 and the second electrode layer 33 respectively cover the two sides of the varistor chip 32, and they may have the same shape as the varistor chip 32.

The overheat protection device 100 is disposed on one side of the second electrode layer 33 away from the first electrode layer 31. The insulator 10 of the thermal protection device 100 is disposed to face the second electrode layer 33; that is, the first electrode 11 and the second electrode 12 of the overheat protection device 100 are located on one side of the insulator 10 away from the second electrode layer 33.

The varistor 100 further includes a first lead 51 and a second lead 52, wherein the first lead 51 is led out by the first electrode layer, the second lead 52 is led out by one of the first electrode 11 and the second electrode 12, and the second electrode layer 33 is electrically connected to the other one of the first electrode 11 and the second electrode 12. As shown in FIG. 7, in this embodiment, the second lead 52 is led out by the second electrode 12, the second electrode layer 33 and the first electrode 11 are electrically connected by a wire 53, and two ends of the wire 53 may be soldered to the second electrode layer 33 and the first electrode 11, respectively. The first lead 51 and the second lead 52 are used to connect the varistor 1000 to an external circuit.

When a circuit where the varistor 1000 is located works normally, abnormal overheat does not happen, and the temperature does not reach the fusing condition of the hot-melt wire 13 in the varistor 100. In this case, the varistor 1000 is in a normal working state.

When there is an abnormal voltage in the circuit where the varistor 1000 is located and the varistor 1000 has an abnormal overvoltage continuously, or when the temperature of the varistor body 300 rises due to another abnormal condition, the varistor body 300 conducts heat to the overheat protection device 100 located thereon. When the temperature reaches a predetermined temperature, the hot-melt wire 13 is melted and broken, such that the electrical connection between the first electrode 11 and the second electrode 12 of the overheat protection device 100 is broken, and the overheat protection device 100 is in an open-circuit state. As a result, the circuit where the varistor 1000 is located is in an open-circuit state, and the varistor body 300 is prevented from being continuously overheated and catching on fire.

In this embodiment, as shown in FIG. 7, the varistor 1000 further includes a heat conductive layer 40 disposed between the second electrode layer 33 and the insulator 10 for conducting the heat from the varistor body 300 to the overheat protection device 100. The heat conductive layer 40 may be a heat conductive adhesive, such that the overheat protection device 100 is adhered and fixed to the second electrode layer 33 and heat may be conducted. The heat conductive layer 40 may also be a solder for soldering and fixing the overheat protection device 100 to the second electrode layer 33, and function to conduct heat.

It can be understood by those skilled in the art that the conductive layer 40 is optional. In some embodiments, the heat conductive layer 40 may be omitted, and the overheat protection device may be directly disposed on the second electrode layer 33.

In some embodiments, the varistor 1000 may further include an encapsulation layer (not shown in FIG. 7) that can integrally clad a combination of the varistor body 300 and the overheat protection device 100. The encapsulation layer is for protecting the varistor body 300, the overheat protection device 100, and the like encapsulated therein. The first lead 51 and the second lead 52 of the varistor 1000 are led out through the encapsulation layer. The encapsulation layer can be made of an epoxy material.

In conclusion, in the overheat protection device and the varistor including the overheat protection device provided in the present disclosure, the materials of the first electrode, the second electrode, and the insulator are selected such that the liquid hot-melt material wets the first electrode and the second electrode and does not wet at least a portion of the insulator. As a result, when the hot-melt wire is melted when the ambient temperature reaches the predetermined temperature, the liquid hot-melt material is collected at the first electrode and the second electrode that are spaced apart from each other, so that the first electrode and the second electrode are completely insulated, thereby ensuring that the thermal protection device is in a complete open-circuit state, and effectively preventing the varistor from being continuously overheated and catching on fire.

Although some embodiments of the general concept of the present invention have been shown and described, it shall be understood by those skilled in the art that modifications and combinations may be made to these embodiments without departing from the principles and spirit of the general concept of the present invention, and the scope of the present invention is defined by the claims and their equivalents.

The invention claimed is:

1. An overheat protection device, comprising:

a first electrode and a second electrode disposed to be spaced apart;

a hot-melt wire located between the first electrode and the second electrode, the hot-melt wire being in electrical contact with the first electrode and the second electrode; and an insulator supporting the first electrode and the second electrode, wherein the hot-melt wire is melted into a liquid hot-melt material when the ambient temperature reaches a predetermined temperature, the liquid hot-melt material wets the first electrode and the second electrode, and the liquid hot-melt material does not wet the insulator at least at a portion located between the first electrode and the second electrode;

wherein the insulator comprises a cylindrical structure, and the first electrode, the second electrode, and the hot-melt wire are disposed in the cylindrical structure with the hot-melt wire disposed on and in direct contact with an interior surface of the cylindrical structure.

2. The overheat protection device according to claim 1, further comprising a protective layer disposed over the hot-melt wire.

3. The overheat protection device according to claim 2, wherein the liquid hot-melt material does not wet the protective layer.

4. The overheat protection device according to claim 1, wherein the overheat protection device further comprises:

at least one wetting component disposed between the first electrode and the second electrode;

wherein the first electrode, the at least one wetting component, and the second electrode are successively and sequentially arranged to be spaced apart in an extension direction of the hot-melt wire, and the liquid hot-melt material wets the wetting component.

5. The overheat protection device according to claim 1, wherein at least one of the first electrode and the second electrode is a layered electrode, a columnar electrode, or a sponge electrode.

6. A varistor comprising:

a varistor body; and the overheat protection device according to claim 1 disposed on the varistor body, wherein compared with the first electrode and the second electrode, the insulator is closer to the varistor body.

7. The varistor according to claim 6, wherein the varistor body comprises a first electrode layer, a varistor chip, and a second electrode layer disposed sequentially to be stacked, and the second electrode layer and the insulator are disposed to face each other.

8. The varistor according to claim 6, wherein the varistor comprises a heat conductive layer, and the heat conductive layer is disposed between the insulator and the second electrode layer.

9. The varistor according to claim 8, wherein the second electrode layer is electrically connected to one of the first electrode and the second electrode, and the varistor further comprises:

a first pin, the first pin being electrically connected to the first electrode layer; and a second pin, the second pin being electrically connected to the other one of the first electrode and the second electrode.

10. The varistor according to claim 8, wherein the varistor further comprises an encapsulation layer, the encapsulation layer cladding the varistor body and the overheat protection device.

* * * * *